United States Patent [19]

Rutherford et al.

[11] 4,147,600

[45] Apr. 3, 1979

[54] ELECTROLYTIC METHOD OF PRODUCING CONCENTRATED HYDROXIDE SOLUTIONS

[75] Inventors: John Rutherford; Charles F. Eggers, both of Tacoma, Wash.

[73] Assignee: Hooker Chemicals & Plastics Corp., Niagara Falls, N.Y.

[21] Appl. No.: 867,647

[22] Filed: Jan. 6, 1978

[51] Int. Cl.[2] ..... C25B 1/26; C25B 1/16

[52] U.S. Cl. ..... 204/98; 204/128

[58] Field of Search ..... 204/98, 128

[56] References Cited

U.S. PATENT DOCUMENTS

| | | | |
|---|---|---|---|
| 1,441,408 | 1/1923 | Dow et al. | 204/98 |
| 3,899,403 | 8/1975 | Cook et al. | 204/98 |
| 3,933,603 | 1/1976 | Ishida et al. | 204/98 |
| 4,057,474 | 11/1977 | Kurtz et al. | 204/98 |
| 4,061,550 | 12/1977 | Cook et al. | 204/98 |

*Primary Examiner*—R. L. Andrews

*Attorney, Agent, or Firm*—Peter F. Casella; Howard M. Ellis

[57] ABSTRACT

A method for economically producing a concentrated alkali metal hydroxide solution by electrolytic means is described. The method involves the tandem operation of diaphragm and membrane electrolytic cells. More particularly, the cell liquor from the diaphragm cell or cells is utilized in place of all or part of the water usually utilized in the catholyte compartment of the membrane cell or cells.

7 Claims, 1 Drawing Figure

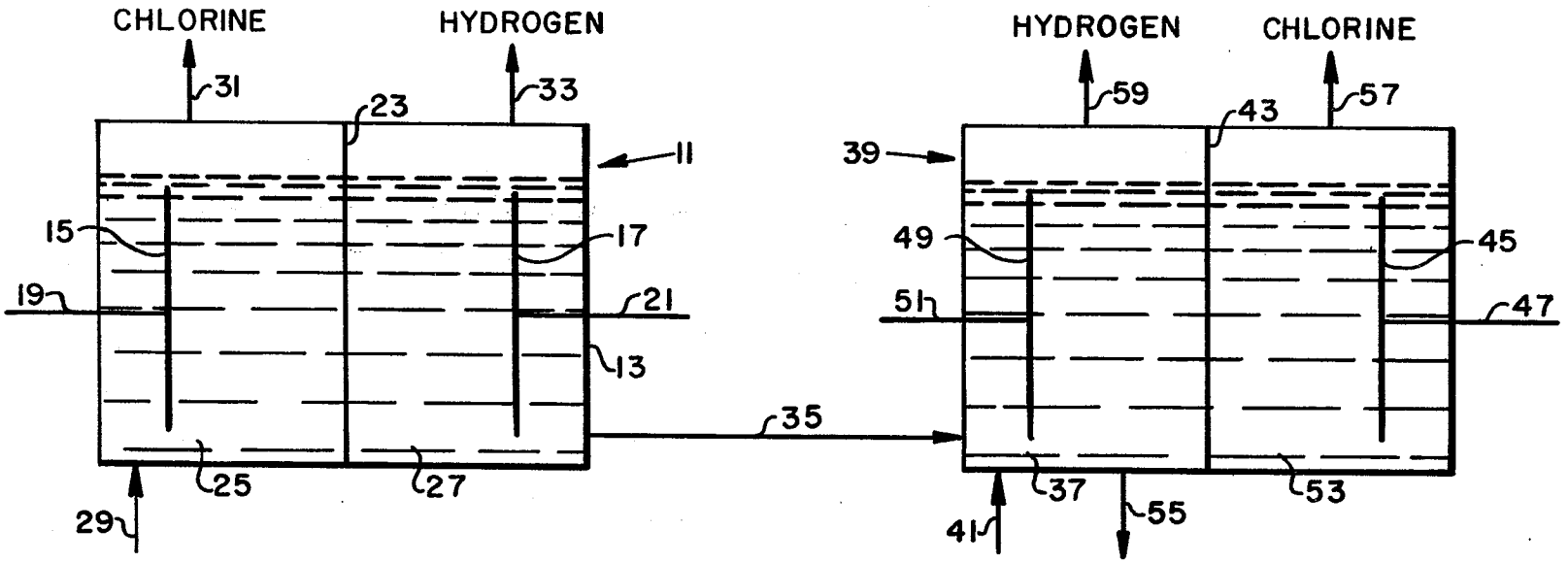
CHLORINE
HYDROGEN
HYDROGEN
CHLORINE
11
13
15
17
19
21
23
25
27
29
31
33
35
37
39
41
43
45
47
49
51
53
55
57
59

ELECTROLYTIC METHOD OF PRODUCING CONCENTRATED HYDROXIDE SOLUTIONS

BACKGROUND OF THE INVENTION

This invention relates to the electrolytic manufacture of hydroxide solutions. More specifically, it relates to a process for producing alkali metal hydroxides in the form of concentrated aqueous solutions by the electrolysis of aqueous alkali metal halide solutions utilizing two different types of electrolytic cells. One type is a diaphragm cell, such as is presently commonly used in industry. The other type is a membrane cell which utilizes at least one permselective membrane.

Chlorine and caustic are essential and large volume chemicals which are required in all industrial societies. They are commercially produced by electrolysis of salt solutions, and a major portion of such production at the present time is by diaphragm cells.

Diaphragm cells useful in the production of chlorine and caustic are well known in the art. Typical of this type of cell is that designated as an "H-4" cell by Hooker Chemicals & Plastics Corp. This type of cell utilizes dimensionally stable anodes, which consist of an active surface of noble metals, alloys, or oxides, or mixtures thereof, deposited on a valve metal substrate. In the operation of a diaphragm cell, a nearly saturated alkali metal halide solution is fed into the anolyte compartment of the cell, from which it passes through a permeable diaphragm, usually of deposited asbestos, to the catholyte compartment, where under a decomposing current, alkali metal hydroxide is formed. Halide gas is formed at the anode, and hydrogen is formed along with alkali metal hydroxide at the cathode.

Membrane cells, or electrolytic cells utilizing permselective membranes to separate the anode and the cathode during electrolysis, are known in the art. For example, such cells are described in U.S. Pat. Nos. 3,899,403; 3,954,579; and 3,959,095. Within recent years, improved membranes have been introduced. The improved membranes are preferably utilized in the present invention. Such membranes are fabricated of a hydrolyzed copolymer of a perfluorinated hydrocarbon and a sulfonated perfluorovinyl ether. More specifically, suitable membrane materials are fabricated of a hydrolyzed copolymer of tetrafluoroethylene and a fluorosulfonated perfluorovinyl ether of the general formula: $FSO_2CF_2CF_2OCF(CF_3)CF_2OCF{=}CF_2$, hereinafter referred to as PSEPVE. Generally, such polymers have an equivalent weight of from about 900 to about 1,600. In use, the membranes are usually supported on networks of supporting materials such as polytetrafluoroethylene, perfluorinated ethylene propylene polymer, polypropylene, asbestos, titanium, tantalum, niobium or noble metals. Utilizing an alkali metal halide feed, a membrane cell produces alkali metal hydroxide and hydrogen at the cathode and halide at the anode.

In processes utilizing membrane or diaphragm electrolytic cells, not all of the alkali metal chloride feed material entering the cell is electrolyzed; a part of the unreacted portion is withdrawn with the hydroxide solution product from the catholyte compartment. This mixture is generally referred to as "cell liquor." The cell liquor from diaphragm cells, for example, normally contains from about 9 to about 12 percent by weight alkali metal hydroxide, and 10 to 18 percent by weight alkali metal chloride together with some alkali metal sulfate. In order to obtain a commercial product, the alkali metal hydroxide must be concentrated and separated from the chlorides and sulfates which may be present. Separation and concentration of the alkali metal hydroxide product is usually accomplished by evaporation of the cell liquor. The evaporation process is normally carried out to produce a marketable product containing about 50 percent by weight alkali metal hydroxide, which product usually contains from about 0.8 to about 2.0 percent alkali metal chlorides.

The expense of evaporation of the alkali metal hydroxide to produce a marketable product that may economically be shipped over long distances is required when either diaphragm or membrane cells are utilized. The capital cost of electrolytic cells and related equipment has steadily increased over recent years. The expense of installing and operating evaporating equipment has also increased as has the cost of fuel or steam. The evaporation step has become the subject of much study toward effectuating more efficient and more economic processes. Rising capital costs have also curtailed expansions in chlor-alkali capacity, especially where a change from one type of electrolytic cell to another is a consideration. Although the present invention is not restricted thereto, it is particularly adapted to the economic expansion of capacity of an existing diaphragm cell plant.

In accord with the present invention, a method has been devised wherein two types of electrolytic cells, diaphragm and membrane cells, are operated in tandem to more economically produce alkali metal hydroxides. The present method produces a viable alternative to expansion of plant capacity. Expansion of installations to include both types of cells has an economic advantage over the expansion of either a wholly diaphragm or a membrane cell installation. The present invention produces a cell liquor of higher alkali metal hydroxide concentration than diaphragm cells normally produce. The concentrated cell liquor, in turn, requires less evaporation to produce a more desirable concentrated product, generally about 50 percent or more by weight alkali metal hydroxide. The present process also facilitates the addition of capacity to chlor-alkali plants to be accomplished by the addition of product capacity, that is, electrolytic cells which produce both chlorine and alkali metal hydroxides, without addition of processing capacity, e.g. evaporators, which process only alkali metal hydroxide solutions.

GENERAL DESCRIPTION OF THE INVENTION

The present invention relates to a process in which diaphragm and membrane cells are used in tandem. More particularly, the product of the diaphragm cell, the diaphragm cell liquor, is utilized as all or part of the water normally utilized in the catholyte compartment of the membrane cell. The present invention is particularly adapted to the production of chlorine and alkali metal hydroxides. When utilized in such process, the product of the membrane cell is a more concentrated alkali metal hydroxide solution than is normally obtained. The high-concentration alkali metal hydroxide solution may be sold, used in chemical reactions, e.g. production of chlorates, or is aptly suited to be evaporated to still higher concentrations, with a consequent saving on steam costs.

Although the process of the present invention may be utilized in the electrolysis of any alkali metal chloride, sodium chloride is preferred, and is normally the alkali metal chloride used. The description hereinafter is directed more particularly to the electrolysis of sodium chloride. Other alkali metal chlorides that might be utilized, more particularly, are potassium and lithium chlorides.

Typically, a diaphragm cell comprises an anode and a cathode separated by a permeable diaphragm or barrier, usually of deposited asbestos or suitable polymeric material. Diaphragm cells utilizing dimensionally stable anodes normally operate at current loads of between about 30,000 and about 150,000 amperes. Usually current efficiencies in the range of between about 88 and about 96 percent are obtained. The brine feed to a diaphragm cell normally contains from about 300 to about 330 grams per liter of sodium chloride at about 60° C. (A saturated solution at about 90° C. contains about 333 grams per liter). Preferably, the brine feed is usually preheated to a temperature between about 50° C. and about 80° C. to prevent deposition of the salt crystals in the feed lines to the cell. The brine is fed into the anolyte compartment of the diaphragm cell. The salt concentration in the anolyte compartment has an effect on the current efficiency. Normally, increasing the chloride concentration in the anolyte compartment results in benefits of higher current efficiency, purer chlorine, lower voltage, higher caustic concentration, and less chlorate in the cell liquor. It is, therefore, desirable to operate diaphragm, or membrane, cells at high salt concentration. However, the solubility of sodium chloride and the temperature of the brine feed limit the expansion of capacity that may be obtained by increasing the amount of sodium chloride starting material fed into the cell.

A decomposition voltage is imposed across the diaphragm cell electrodes, and a head is maintained in the anolyte compartment sufficient to maintain flow through the permeable diaphragm, into the catholyte compartment. Sodium hydroxide is formed in the catholyte compartment and is withdrawn from the catholyte compartment as a component of the cell liquor.

In accord with the present invention, the diaphragm cell liquor is utilized as feed stock to the catholyte compartment of a membrane cell in place of water normally added. The solubility of the sodium chloride is again a limiting factor. The concentration of sodium chloride and the temperature of the catholyte feed solution are to be considered. Additional water may need to be added to the catholyte compartment to prevent "salting out" of sodium chloride in the cell. Although the present invention will be described in terms of a two-compartment membrane cell, which is a preferred embodiment, it will be understood that membrane cells having a plurality of intermediate or buffer compartments may be utilized.

A membrane cell has an anolyte and a catholyte compartment separated by one or more membranes, preferably of the PSEPVE type described above. Such membranes may be classified as "cation-active permselective", that is, membranes that resist the passage therethrough of solutions, but are selectively permeable to cations. Normally, the membrane wall thickness will range from about 0.02 to about 0.5 mm., preferably, from about 0.1 to about 0.5 mm., and, most preferably, from about 0.1 to about 0.3 mm. When mounted on polytetrafluoroethylene, asbestos, titanium or other suitable network for support, the network filaments or fibers will usually have a thickness of from about 0.01 to about 0.5 mm, and, preferably, from about 0.05 to about 0.15 mm., corresponding to the thickness of the membrane.

The electrodes of a membrane cell may be made of any electrically conductive material which will resist the attack of the various cell contents. Similar to diaphragm cells, the cathodes may be made of iron, steel, or a platinum group metal, such as platinum, iridium, osmium, or ruthenium. In using such metals, the metal may be deposited on conductive surfaces such as copper or steel. However, the cathodes are preferably and most practically fabricated of iron or steel. The anodes generally useful in membrane cells preferably are constructed of platinum group metals, or, more practically, have surfaces or coating of platinum group metals, alloys, oxides, or mixtures thereof. When such coated anodes are used, it is preferred that the substrate of the anode be a valve metal such as titanium.

Typically, a membrane cell utilizes a concentrated brine feed entering the anolyte compartment and operates at current densities between about 0.5 to about 4.0 amperes per square inch, and, preferably, between about 1.0 to about 3.0 amperes per square inch. Current efficiencies from about 85 to about 95 percent are normally obtained. Voltage drops from anode to cathode are usually in the range of from about 2.3 to about 5.0 volts.

Operating within these parameters and utilizing a feed of diaphragm cell liquor containing about 140 grams per liter sodium hydroxide and about 175 grams per liter sodium chloride into the catholyte compartment, the cell liquor product taken from the membrane cell contains from about 230 to about 350 grams per liter sodium hydroxide, and from about 60 to about 120 grams per liter sodium chloride.

DETAILED DESCRIPTION OF THE INVENTION

The following detailed description will utilize the attached drawing which is incorporated herein. The drawing is a schematic diagram of a diaphragm cell for the production of sodium hydroxide and chlorine operated in tandem with a two-compartment membrane cell to increase the caustic concentration of the cell liquor from the diaphragm cell.

In the FIGURE, the points of addition and withdrawal of typical and preferred reactants and products are illustrated. Diaphragm electrolytic cell 11 includes outer wall 13, anode 15, cathode 17, and conductive means 19 and 21 for connecting the anode and the cathode respectively to sources of positive and negative electricity. Inside the cell wall, permeable diaphragm 23 separates the cell into an anode or anolyte compartment 25 and a cathode or catholyte compartment 27. An aqueous solution containing about 300 grams per liter of sodium chloride, preferably acidic, is fed into the anolyte compartment 25 through line 29. During electrolysis, chlorine gas is removed from above the anolyte compartment through line 31, and hydrogen gas is removed from above the catholyte compartment through line 33. A solution containing about 140 grams per liter sodium hydroxide and about 175 grams per liter sodium chloride is withdrawn from the catholyte compartment through line 35 and fed into the catholyte compartment 37 of membrane cell 39. Water flux may also be added to compartment 37 through line 41 to maintain the desired flow across the membrane and control the concentration of caustic in that compartment, thereby maintaining a high current efficiency by limiting the back migration of hydroxyl ions to the anolyte compartment through membrane 43.

In membrane cell 39, anode 45 is connected to a source of positive electric potential by conductor 47, and cathode 49 is similarly connected by corresponding conductor 51. A cation-active permselective membrane 43 separates catholyte compartment 37 and anolyte compartment 53. A concentrated sodium hydroxide solution, 200 grams per liter or more, is produced in catholyte compartment 37 and is withdrawn from the compartment through line 55. Chlorine and hydrogen are withdrawn from the anolyte and catholyte compartments respectively through lines 57 and 59.

The high concentration sodium hydroxide solution so produced may be sold, employed in chemical reactions, for example, to produce chlorate, or may be evaporated to higher concentrations. The chlorine produced may be sold, usually after liquifaction to remove any oxygen present. The chlorine and hydrogen produced in the two cells may be combined and may fed into common headers or collectors.

While the invention has been illustrated on the basis of one diaphragm cell to one membrane cell, it will be understood that this ratio may vary in accord with the capacity of the cells. Thus, several diaphragm cells may feed one membrane cell, or one diaphragm cell may feed several membrane cells.

The following example is illustrative and is not to be interpreted as limiting the present invention. Unless otherwise indicated, all parts are by weight and all temperatures are in ° C.

EXAMPLE

An aqueous brine feed containing about 321 grams per liter sodium chloride at about 60° was fed into the anolyte compartment of a diaphragm electrolytic cell, designated by Hooker Chemicals & Plastics Corp. as an "H-4" cell. The cell was equipped with dimensionally stable anodes having a substrate of titanium with a coating of platinum group metals and platinum group metal oxides. The cell utilized a steel cathode and a deposited asbestos diaphragm. A current load of 33.6 KA was utilized to decompose the sodium chloride solution. A current efficiency of 90.5 percent was maintained. A cell liquor at about 90° comprising 140 grams per liter sodium hydroxide, 175 grams per liter sodium chloride, and 913 grams per liter water was removed from the catholyte compartment.

The diaphragm cell liquor was then filtered and fed at the rate of 0.15 gallons per minute into the catholyte compartment of a membrane electrolytic cell. The membrane cell is the type designated as an "MX" cell by Hooker Chemicals & Plastics Corp. The cell was equipped with anodes and cathodes fabricated of similar materials as the corresponding components of the diaphragm cell discussed above. The cell was equipped with a permselective membrane of the PSEPVE type. A water flux of about 1.6 gallons per hour was added to prevent salting out. The membrane cell was operated at a current density of 2 KA, about 1.16 amperes per square inch of anode area. The anolyte temperature was 71°.

The sodium hydroxide content of the cell liquor from the membrane cell varied over a range from about 200 grams per liter, at start up, to about 340 grams per liter, under stabilized operating conditions. The sodium chloride content similarly varied from about 55 to about 140 grams per liter. The tandem operation was carried out over a period of about 550 hours.

The invention has been described with respect to a working example and illustrative embodiments but is not to be limited to these, because it is evident that one of ordinary skill in the art will be able to utilize substitutes and equivalents without departing from the spirit of the invention or the scope of the claims.

1. A method of electrolytically producing a concentrated aqueous alkali metal hydroxide solution utilizing a diaphragm electrolytic cell and a membrane electrolytic cell comprising the steps of:

(a) feeding aqueous alkali metal halide into a diaphragm electrolytic cell, said cell having a permeable diaphragm separating an anolyte and a catholyte compartment, (b) electrolytically decomposing said alkali metal halide to produce halogen in the anolyte compartment and hydrogen and alkali metal hydroxide in the catholyte compartment, (c) removing an aqueous solution comprising alkali metal hydroxide and alkali metal halide from said catholyte compartment, (d) feeding said solution into the catholyte compartment of a membrane electrolytic cell, while feeding an aqueous alkali metal halide solution into the anolyte compartment of the membrane cell, said membrane electrolytic cell having a permselective membrane positioned between the catholyte and anolyte compartments, (e) electrolytically decomposing additional alkali metal halide in said membrane cell to produce halogen in the anolyte compartment and hydrogen and alkali metal hydroxide in the catholytic compartment, and, (f) removing from the catholyte compartment of said membrane cell a concentrated aqueous alkali metal hydroxide solution having a reduced concentration of alkali metal halide.

2. The method of claim 1 wherein the permselective membrane is a hydrolyzed copolymer of tetrafluoroethylene and a fluorosulfonated perfluorovinyl ether, having the general formula: $FSO_2CF_2CF_2OCF(CF_3)CF_2OCF{=}CF_2$.

3. The method of claim 2 wherein the membrane electrolytic cell contains a buffer compartment separating said anolyte and said catholyte compartments, said buffer compartment formed between two permselective membranes.

4. The method of claim 1 wherein the alkali metal halide is sodium chloride.

5. The method of claim 1 wherein the permeable diaphragm consists of an asbestos diaphragm.

6. The method of claim 1 wherein the concentrated alkali metal hydroxide solution contains at least about 200 grams per liter alkali metal hydroxide.

7. The method of claim 1 wherein the concentrated alkali metal hydroxide solution is evaporated to produce a product containing at least about 50 percent by weight alkali metal hydroxide.

* * * * *